US011802484B2

(12) United States Patent
Nishimura

(10) Patent No.: US 11,802,484 B2
(45) Date of Patent: Oct. 31, 2023

(54) TURBINE BLADE AND GAS TURBINE

(71) Applicant: MITSUBISHI HEAVY INDUSTRIES, LTD., Tokyo (JP)

(72) Inventor: Kazuya Nishimura, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/771,912

(22) PCT Filed: Nov. 9, 2020

(86) PCT No.: PCT/JP2020/041775
§ 371 (c)(1),
(2) Date: Apr. 26, 2022

(87) PCT Pub. No.: WO2021/095695
PCT Pub. Date: May 20, 2021

(65) Prior Publication Data

US 2022/0372880 A1 Nov. 24, 2022

(30) Foreign Application Priority Data

Nov. 14, 2019 (JP) ..... 2019-205907

(51) Int. Cl.
*F01D 5/18* (2006.01)
*F01D 5/20* (2006.01)

(52) U.S. Cl.
CPC ..... *F01D 5/187* (2013.01); *F01D 5/20* (2013.01); *F05D 2240/307* (2013.01); *F05D 2240/35* (2013.01); *F05D 2260/202* (2013.01)

(58) Field of Classification Search
CPC ..... F01D 5/187; F01D 5/20; F05D 2240/307; F05D 2260/202
See application file for complete search history.

(56) References Cited

U.S. PATENT DOCUMENTS 5,482,435 A * 1/1996 Dorris ..... F01D 5/225 415/115
6,499,950 B2 * 12/2002 Willett ..... F01D 5/182 416/189

(Continued)

FOREIGN PATENT DOCUMENTS

JP 10-317904 12/1998
JP 2000-291405 10/2000

(Continued)

OTHER PUBLICATIONS

International Search Report dated Jan. 12, 2021 in International Application No. PCT/JP2020/041775, with English-language translation.

(Continued)

*Primary Examiner* — Eldon T Brockman
(74) *Attorney, Agent, or Firm* — Wenderoth, Lind & Ponack, L.L.P.

(57) ABSTRACT

A turbine blade includes: an airfoil portion extending in a blade height direction and having a pressure surface and a suction surface each of which extends between a leading and trailing edges; a shroud portion disposed on a blade tip side of the airfoil portion; a fillet portion formed by a curved surface and connected to an end portion of the shroud portion on a side of the airfoil portion; at least one first cooling hole extending along the blade height direction within the airfoil portion; at least one cooling cavity disposed at least partially within the shroud portion and communicating with the at least one first cooling hole; and a second cooling hole connected to the at least one cooling cavity and opening to a surface of the shroud portion. The airfoil portion has a reference airfoil in which a maximum blade thickness is minimum at a reference position.

13 Claims, 10 Drawing Sheets

(56) References Cited

U.S. PATENT DOCUMENTS

| | | | | |
|---|---|---|---|---|
| 6,761,534 | B1 * | 7/2004 | Willett | F01D 5/225 416/191 |
| 10,655,478 | B2 * | 5/2020 | Takamura | F02C 7/18 |
| 10,890,073 | B2 * | 1/2021 | Takamura | F01D 5/187 |
| 11,225,872 | B2 * | 1/2022 | Myers | F01D 5/187 |
| 2001/0048878 | A1 * | 12/2001 | Willett | F01D 25/12 416/97 R |
| 2017/0175535 | A1 * | 6/2017 | Chouhan | F01D 5/187 |
| 2018/0128116 | A1 | 5/2018 | Takamura et al. | |
| 2018/0149024 | A1 | 5/2018 | Takamura et al. | |

FOREIGN PATENT DOCUMENTS

| | | |
|---|---|---|
| JP | 2000-297604 | 10/2000 |
| JP | 2017-44092 | 3/2017 |
| JP | 2017-44093 | 3/2017 |

OTHER PUBLICATIONS

English translation of the International Preliminary Report on Patentability dated May 27, 2022 in International Application No. PCT/JP2020/041775.

* cited by examiner

TURBINE BLADE AND GAS TURBINE

TECHNICAL FIELD

The present disclosure relates to a turbine blade and a gas turbine.

BACKGROUND ART

As a turbine blade for a gas turbine or the like, a turbine blade having a cooling cavity at a blade tip portion may be used.

For example, Patent Document 1 discloses a turbine blade for a gas turbine having an airfoil portion and a tip shroud with a plurality of radial cooling holes extending through the airfoil portion and an enlarged internal portion (cavity) disposed within the tip shroud and communicating with the radial cooling holes. A cooling medium supplied to the radial cooling holes passes through the radial cooling holes, is introduced into the enlarged internal portion within the tip shroud, and then discharged out of the turbine blade. Thus, the airfoil portion and the tip shroud of the turbine blade are cooled.

CITATION LIST

Patent Literature

Patent Document 1: JP2000-297604A

SUMMARY

Problems to be Solved

As a turbine rotor rotates, a centrifugal load acts on a rotating blade (rotor blade) of a gas turbine. When a large centrifugal load is applied to a turbine blade, the life of the turbine blade may be shortened, so it is desired to reduce the centrifugal load acting on the turbine blade.

In view of the above, an object of at least one embodiment of the present invention is to provide a turbine blade and a gas turbine whereby it is possible to reduce a centrifugal load acting on the turbine blade.

Solution to the Problems

A turbine blade according to at least one embodiment of the present invention comprises: an airfoil portion extending in a blade height direction and having a pressure surface and a suction surface each of which extends between a leading edge and a trailing edge; a shroud portion disposed on a blade tip side of the airfoil portion; a fillet portion formed by a curved surface and connected to an end portion of the shroud portion on a side of the airfoil portion; at least one first cooling hole extending along the blade height direction within the airfoil portion; at least one cooling cavity disposed at least partially within the shroud portion and communicating with the at least one first cooling hole; and a second cooling hole connected to the at least one cooling cavity and opening to a surface of the shroud portion. The airfoil portion has a reference airfoil in which a maximum blade thickness is minimum at a reference position in the blade height direction. The at least one cooling cavity includes a cavity extending so as to overlap the fillet portion in the blade height direction. In a cross-section perpendicular to the blade height direction and including the cavity, the cavity extends inside and outside a region where a contour of the reference airfoil is projected on the cross-section in the blade height direction.

A gas turbine according to at least one embodiment of the present invention comprises: the above-described turbine blade and a combustor for producing a combustion gas flowing through a combustion gas passage provided with the turbine blade.

Advantageous Effects

At least one embodiment of the present invention provides a turbine blade and a gas turbine whereby it is possible to reduce a centrifugal load acting on the turbine blade.

DETAILED DESCRIPTION

Embodiments of the present invention will now be described in detail with reference to the accompanying drawings. It is intended, however, that unless particularly identified, dimensions, materials, shapes, relative positions, and the like of components described in the embodiments shall be interpreted as illustrative only and not intended to limit the scope of the present invention.

(Configuration of gas turbine) First, a gas turbine to which a turbine blade according to some embodiments is applied will be described.

Figure 1:
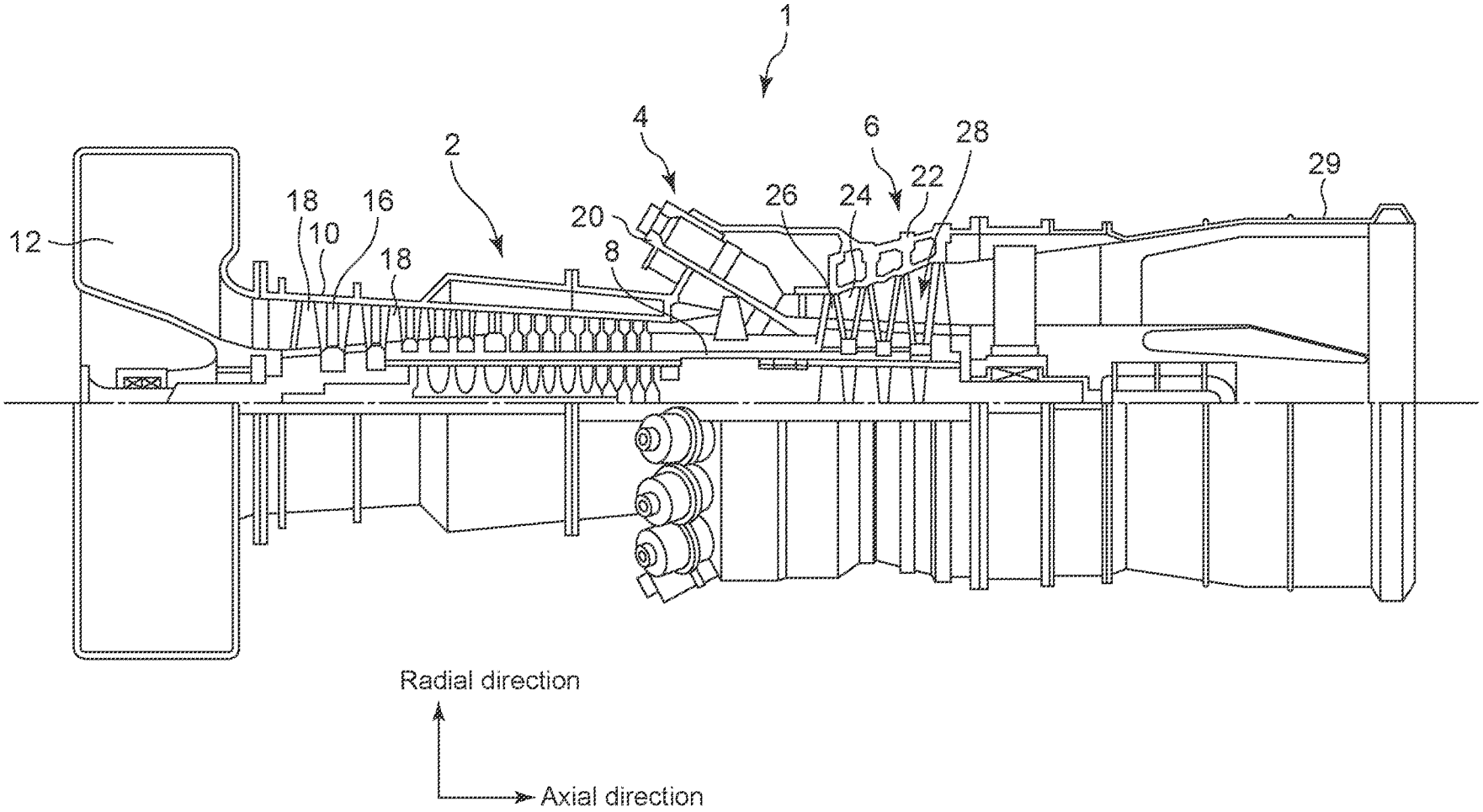
FIG. 1 is a schematic configuration diagram of a gas turbine to which a turbine blade according to an embodiment is applied.

FIG. 1 is a schematic configuration diagram of a gas turbine to which a turbine blade according to an embodiment is applied. As shown in FIG. 1, the gas turbine 1 includes a compressor 2 for producing compressed air, a combustor 4 for producing combustion gas from the compressed air and fuel, and a turbine 6 configured to be rotationally driven by the combustion gas. In the case of the gas turbine 1 for power generation, a generator (not shown) is connected to the turbine 6.

The compressor 2 includes a plurality of stator blades 16 fixed to a compressor casing 10 and a plurality of rotor blades 18 implanted on a rotor 8 so as to be arranged alternately with the stator blades 16. The compressor 2 is supplied with air sucked in through an air inlet 12. The air flows through the plurality of stator blades 16 and the plurality of rotor blades 18 and is compressed into compressed air having a high temperature and a high pressure.

The combustor 4 is supplied with fuel and the compressed air produced in the compressor 2. The combustor 4 mixes the fuel and the compressed air and combusts the mixture to produce a combustion gas that serves as a working fluid of the turbine 6. As shown in FIG. 1, a plurality of combustors 4 may be disposed along the circumferential direction around the rotor inside a casing 20.

The turbine 6 has a combustion gas passage 28 formed inside a turbine casing 22 and includes a plurality of stator blades 24 and a plurality of rotor blades 26 disposed in the combustion gas passage 28. The stator blades 24 are fixed to the turbine casing 22, and a set of the stator blades 24 arranged along the circumferential direction of the rotor 8 forms a stator blade array. Further, the rotor blades 26 are implanted on the rotor 8, and a set of the rotor blades 26 arranged along the circumferential direction of the rotor 8 forms a rotor blade array. The stator blade arrays and the rotor blade arrays are arranged alternately in the axial direction of the rotor 8.

In the turbine 6, as the combustion gas introduced from the combustor 4 into the combustion gas passage 28 passes through the plurality of stator blades 24 and the plurality of rotor blades 26, the rotor 8 is rotationally driven. Thereby, the generator connected to the rotor 8 is driven to generate power. The combustion gas having driven the turbine 6 is discharged outside via an exhaust chamber 29.

In some embodiments, at least one of the rotor blade 26 or the stator blade 24 of the turbine 6 is a turbine blade 30 described below.

(Configuration of Turbine Blade)

Figure 2:
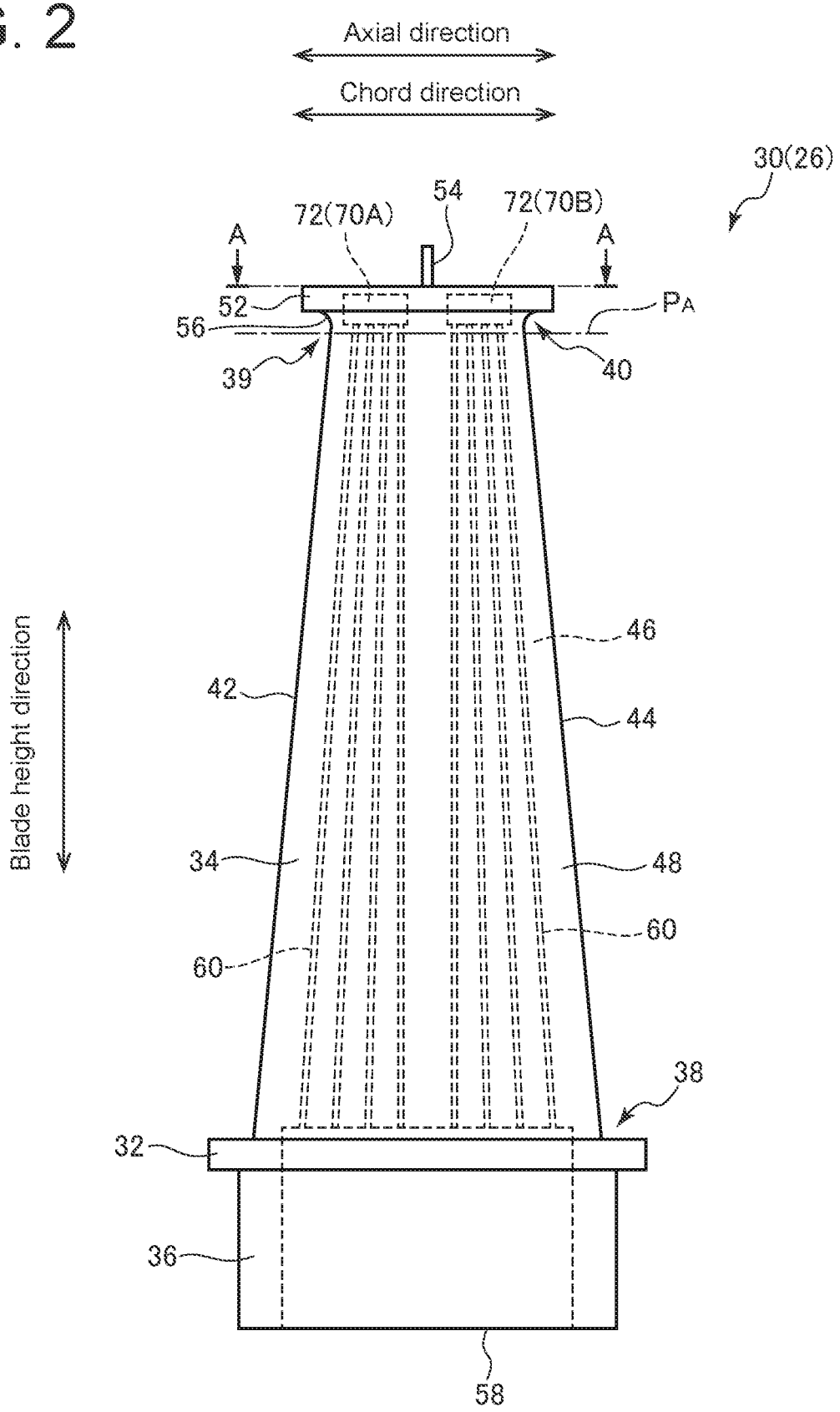
FIG. 2 is a schematic diagram of a turbine blade (rotor blade) according to an embodiment, when viewed in a direction from the suction surface to the pressure surface.
Figure 3:
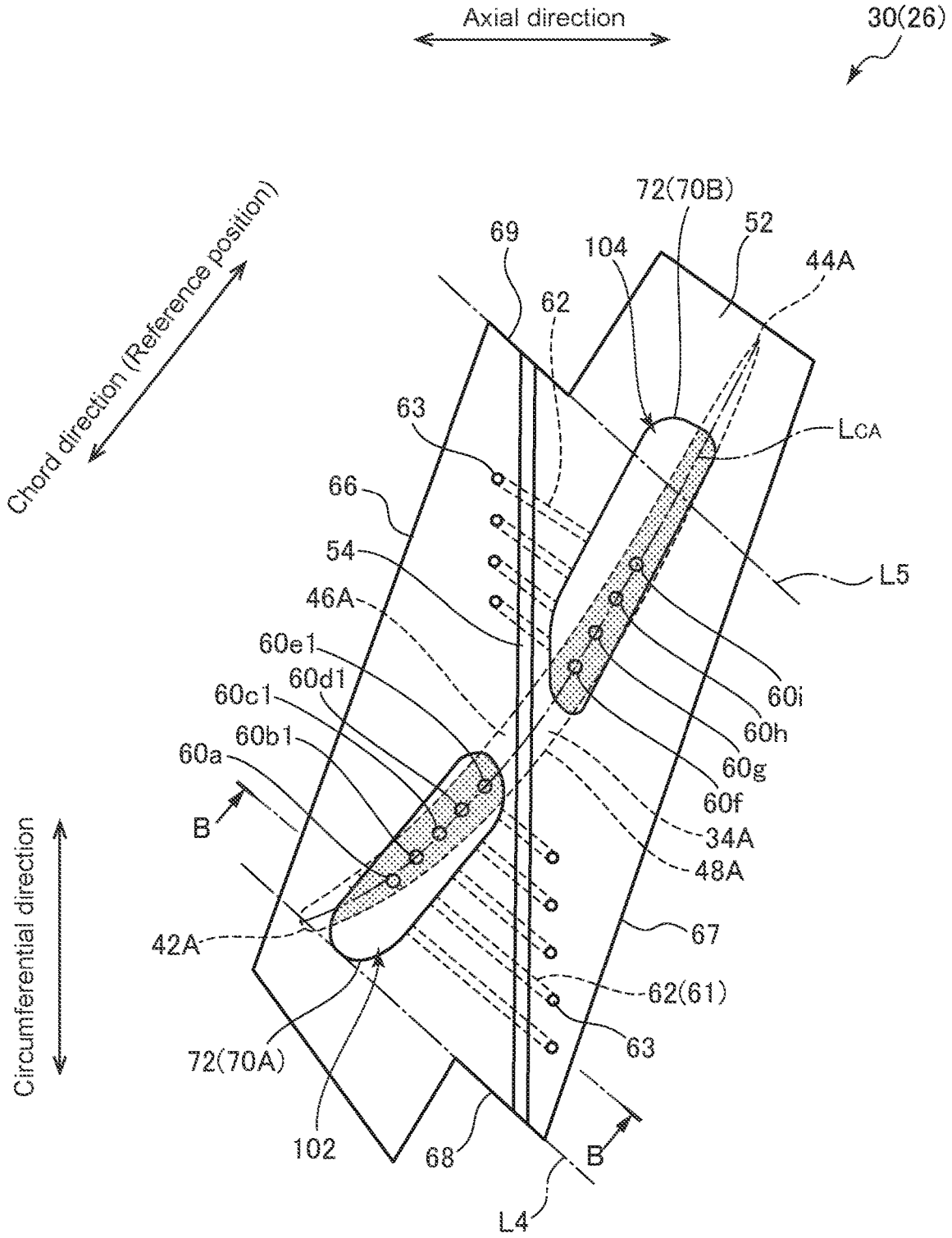
FIG. 3 is a diagram of the turbine blade shown in FIG. 2 when viewed in the blade height direction, which is taken along the line A-A of FIG. 2.
Figure 4:
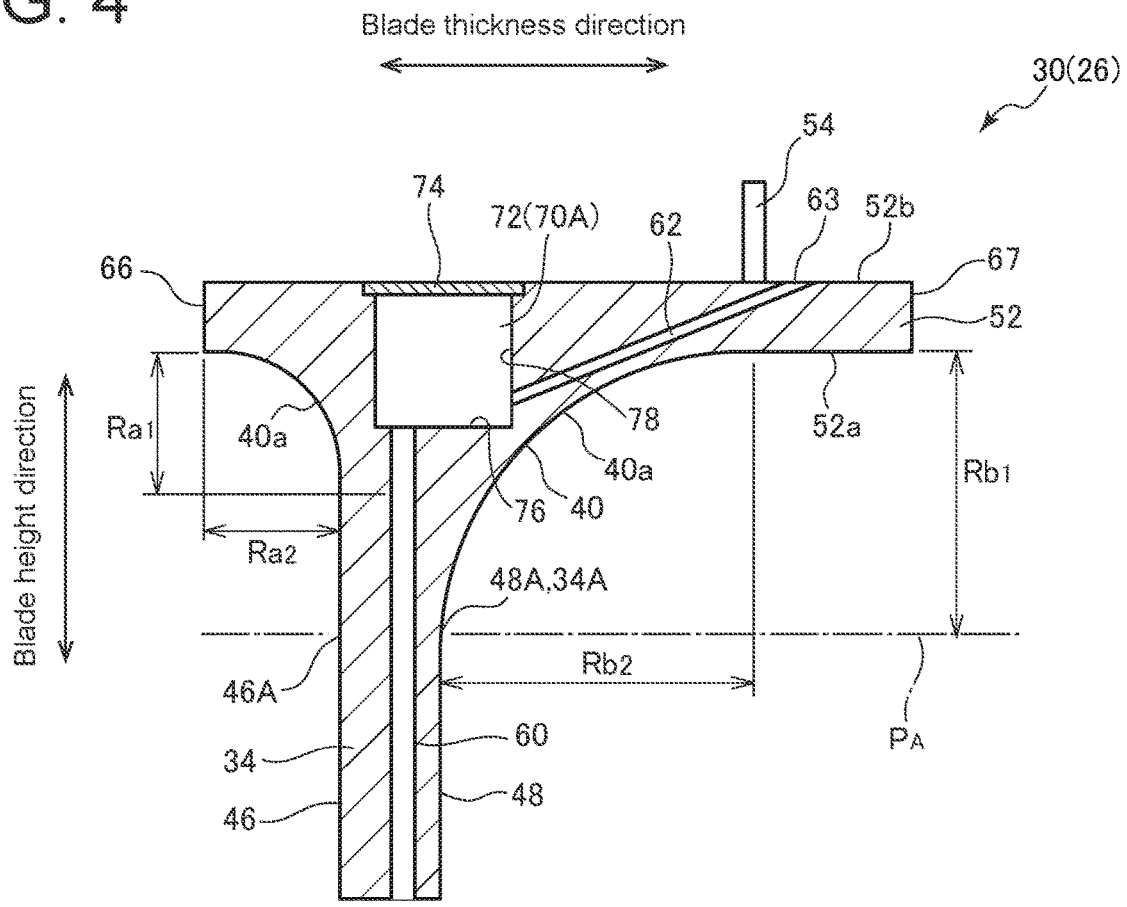
FIG. 4 is a schematic cross-sectional view taken along line B-B in FIG. 3.
Figure 10:
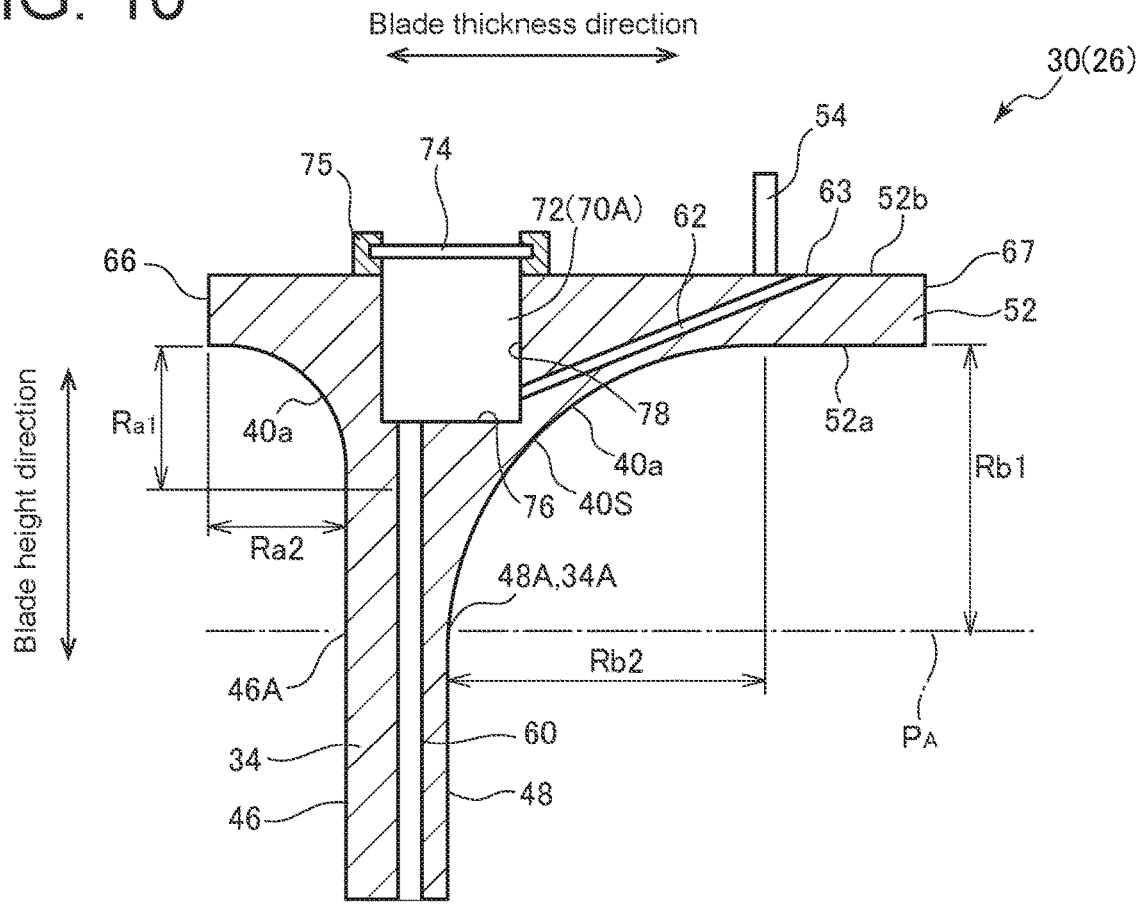
FIG. 10 is a diagram of a turbine blade including a cavity according to an embodiment.

The turbine blade 30 according to some embodiments will now be described in more detail. FIG. 2 is a schematic diagram of a turbine blade 30 (rotor blade 26) according to an embodiment, when viewed in a direction from the suction surface to the pressure surface (direction along the rotor circumferential direction). FIG. 3 is a diagram of the turbine blade 30 shown in FIG. 2 when viewed in the blade height direction, which is taken along the line A-A of FIG. 2. FIG. 4 is a schematic cross-sectional view taken along line B-B in FIG. 3. FIG. 10 is a diagram showing the turbine blade 30 according to another embodiment different from FIG. 4 and corresponds to the cross-section taken along the line B-B in FIG. 3. In FIG. 2, a plug (described later; see FIG. 4) for closing the opening of the cavity is not depicted.

As shown in FIGS. 2 to 4, the turbine blade 30 (rotor blade 26) according to an embodiment includes a platform 32, an airfoil portion 34 and a blade root portion 36 connected to the platform 32, a shroud portion 52 disposed on the blade tip side of the airfoil portion 34, and a fillet portion 40 connected to the shroud portion 52. Further, the turbine blade 30 includes a fin 54 to reduce fluid leakage at the blade tip portion of the turbine blade 30.

The airfoil portion 34 extends in the blade height direction (span direction), has a base end portion 38 and a tip end portion 39 which are both end portions in the blade height direction, and is connected at the base end portion 38 to the platform 32. Further, the airfoil portion 34 has a leading edge 42 and a trailing edge 44 extending along the blade height direction, and has a pressure surface 46 and a suction surface 48 extending between the leading edge 42 and the trailing edge 44. The airfoil portion 34 may have a shape twisted with distance from the base end portion 38 to the tip end portion 39 in the blade height direction.

The blade root portion 36 is disposed on the opposite side of the platform 32 from the airfoil portion 34 in the blade height direction. The blade root portion 36 includes an engagement portion of uneven shape. The engagement portion is engaged with a blade groove in a rotor disc (not shown), which rotates with the rotor 8, so that the turbine blade 30 is attached to the rotor 8 of the turbine 6.

When the turbine blade 30 is attached to the rotor 8, the blade height direction is along the radial direction of the turbine 6. In other words, the blade height direction of the turbine blade 30 substantially coincides with the radial direction of the turbine 6.

As shown in FIG. 2 or 4, the fillet portion 40 is formed by a curved surface 40*a* and is connected to an end portion of the airfoil portion 34 adjacent to the shroud portion 52. The fillet portion 40 may be connected to a flat surface 52*a* of the shroud portion 52 extending along the direction perpendicular to the blade height. The fillet portion 40 formed by the curved surface 40*a* can relax the stress concentration at the connection of the shroud portion 52 with the airfoil portion 34.

Here, the position where the maximum blade thickness of the airfoil portion 34 is minimum in the blade height direction is defined as a reference position $P_A$, and the airfoil of the airfoil portion 34 at the reference position is defined as a reference airfoil 34A. In other words, the airfoil portion 34 has the reference airfoil 34A in which the maximum blade thickness is minimum at the reference position $P_A$ in the blade height direction. The reference position PA substantially coincides with the start position of the fillet portion in a direction from the base end portion 38 to the tip end portion 39 in the blade height direction.

In FIG. 3, the reference airfoil 34A projected in the blade height direction on a plane perpendicular to the blade height direction is shown by the dashed line. The reference airfoil 34A has a leading edge 42A, a trailing edge 44A, a pressure surface 46A, and a suction surface 48A. The direction connecting the leading edge 42A and the trailing edge 44A of the reference airfoil 34A is the chord direction of the reference airfoil 34A. Further, FIG. 3 shows a camber line $Lc_A$ of the reference airfoil 34A. Hereinafter, the leading edge 42A, the trailing edge 44A, the pressure surface 46A, the suction surface 48A of the reference airfoil 34A are simply referred to as the leading edge 42A, the trailing edge 44A, the pressure surface 46A, and the suction surface 48A.

The shroud portion 52 is fixed to the tip end portion 39 of the airfoil portion 34 via the fillet portion 40. As shown in FIG. 3, the shroud portion 52 has an upstream end surface 66 disposed on the upstream side and a downstream end surface 67 disposed on the downstream side of a fluid (combustion gas) flowing through the combustion gas passage 28 (see FIG. 1) of the turbine 6. Further, the shroud portion 52 has a first abutment surface 68 (contact surface) disposed on the leading edge 42A side of the reference airfoil 34A and a second abutment surface 69 (contact surface) disposed on the trailing edge 44A side of the reference airfoil 34A. The first abutment surface 68 and the second abutment surface 69 extend along the blade height direction and extend in a direction intersecting the circumferential direction and/or the axial direction of the rotor 8 (hereinafter, also simply referred to as circumferential direction or axial direction) when viewed in the blade height direction.

The contact surfaces (first abutment surface 68 and second abutment surface 69) of the shroud portion 52 are disposed so as to face shroud portions 52 of adjacent turbine blades 30. Specifically, the first abutment surface 68 of the shroud portion 52 of one turbine blade 30 faces and can abut on the second abutment surface 69 of the shroud portion 52 of another turbine blade 30 adjacent to the one turbine blade 30. Further, the second abutment surface 69 of the shroud portion 52 of one turbine blade 30 faces and can abut on the first abutment surface 68 of the shroud portion 52 of another turbine blade 30 adjacent to the one turbine blade 30. This restricts the movement of the turbine blade 30 in the circumferential direction and/or the axial direction.

The fin 54 protrudes from the shroud portion 52 to the blade tip side and extends along the circumferential direction. The fins 54 of multiple turbine blades 30 arranged in the circumferential direction form an annular seal portion.

The turbine blade 30 further includes a plurality of first cooling holes 60 (60*a* to 60*i*), at least one cooling cavity 70 (70A, 70B), and a plurality of second cooling holes 62.

Each of the first cooling holes 60 extends along the blade height direction within the airfoil portion 34. Typically, the first cooling holes 60 are arranged along the camber line of the airfoil portion 34. The cooling cavity 70 is disposed at least partially within the shroud portion 52 and communicates with at least one first cooling hole 60. Each of the second cooling holes 62 is connected to the cooling cavity 70 and opens to a surface of the shroud portion 52. The second cooling hole 62 may open to a blade tip-side end surface 52*b* (see FIG. 4) of the shroud portion 52 or may open to the upstream end surface 66 or the downstream end surface 67.

The open end portion of the cooling cavity 70 on the blade tip side in the blade height direction is provided with a plug 74 for closing the open end portion. This suppresses the leakage of a fluid in the cooling cavity 70 through the open end portion.

The plug 74 may have a plate shape. The plug 74 may be fitted in a notch provided in the blade tip-side end surface 52*b* of the shroud portion 52 along the contour of the cooling cavity 70, for example as shown in FIG. 4. The surface of the plug 74 and the blade tip-side end surface 52*b* of the shroud portion 52 may be flush with each other. Alternatively, the plug 74 may be fitted in a groove provided in a padding portion 75 disposed on the blade tip-side end surface 52*b* along the contour of the cooling cavity 70, for example as shown in FIG. 10. Alternatively, although not particularly depicted, the plug 74 may be fitted in a groove provided in the inner wall surface (side wall surface) 78 of the cooling cavity 70.

In the exemplary embodiment shown in FIGS. 2 to 4, the at least one cooling cavity 70 includes a leading edge-side cavity 70A and a trailing edge-side cavity 70B disposed on the trailing edge (44A) side of the leading edge-side cavity 70A in the chord direction (see FIG. 3) of the airfoil portion 34 at the reference position $P_A$ (i.e., reference airfoil 34A).

The leading edge-side cavity 70A is connected to a plurality of first cooling holes 60*a* to 60*e*. The first cooling holes 60*a*, 60*b*, 60*c*, 60*d*, 60*e* are arranged in this order from the leading edge 42A to the trailing edge 44A along the camber line $Lc_A$. The trailing edge-side cavity 70B is connected to a plurality of first cooling holes 60*f* to 60*i*. The first cooling holes 60*f*, 60*g*, 60*h*, 60*i* are arranged in this order from the leading edge 42A to the trailing edge 44A along the camber line $Lc_A$.

In the exemplary embodiment shown in FIGS. 2 to 4, the first cooling hole 60 opens to a bottom surface 76 of the cooling cavity 70. Further, the second cooling hole 62 opens to an inner wall surface (side wall surface) 78 of the cooling cavity 70.

The plurality of first cooling holes 60 is supplied with a cooling fluid (e.g., air) through an inlet opening 58 which opens to an end portion of the blade root portion 36 of the turbine blade 30. The cooling fluid supplied to the first cooling holes 60 flows through the first cooling holes 60 toward the blade tip side, passes through the first cooling holes 60, and is then retained in the cooling cavity 70. The cooling fluid in the cooling cavity 70 flows through the second cooling holes 62 and is discharged out of the turbine blade 30 through openings 63 in the surface of the shroud portion 52. Thus, as the cooling fluid flows within the turbine blade 30, the turbine blade 30 including the airfoil portion 34 and the shroud portion 52 is cooled.

In some embodiments, at least one cooling cavity 70 is a cavity 72 described below. Specifically, the cavity 72 extends so as to overlap the fillet portion 40 in the blade height direction and, in a cross-section perpendicular to the blade height direction and including the cavity 72, the cavity 72 extends inside and outside a region where the contour of the reference airfoil 34A is projected on the cross-section in the blade height direction (the region shown as the reference airfoil 34A in FIG. 3).

The turbine blade 30 may have the above-described cross-section (the cross-section in which the cavity 72 extends inside and outside the projection region of the contour of the reference airfoil 34A) in at least one position within the extension range of the cavity 72 in the blade height direction. For example, the turbine blade 30 may have the above-described cross-section over a range of not less than 30% or not less than 50% of the extension region of the cavity 72 in the blade height direction.

In the exemplary embodiment shown in FIGS. 2 to 4, the leading edge-side cavity 70A and the trailing edge-side cavity 70B are the above-described cavities 72.

For example, as shown in FIG. 4, on the pressure surface 46 side, the fillet portion 40 extends within the region Ra1 in the blade height direction and extends within the region Ra2 in the blade thickness direction. On the suction surface 48 side, the fillet portion 40 extends within the region Rb1 in the blade height direction and extends within the region Rb2 in the blade thickness direction. Further, the cavity 72 is disposed so as to at least partially overlap in the blade height direction the extension region Ra1 of the fillet portion 40 on the pressure surface 46 side and the extension region Rb1 of the fillet portion 40 on the suction surface 48 side.

Further, as shown in FIG. 3, when viewed in the blade height direction, the cavity 72 includes an inner portion (in FIG. 3, the portion of the cavity 72 filled with dots) extending inside the contour of the reference airfoil 34A and an outer portion (in FIG. 3, the portion of the cavity 72 not filled with dots) extending outside the reference airfoil 34.

According to the above-described embodiment, the cavity 72 (leading edge-side cavity 70A and trailing edge-side cavity 70B) is disposed in the blade tip portion of the turbine blade 30 including the shroud portion 52. The depth of the cavity 72 extends to the fillet portion 40 in the blade height direction. In a cross-section perpendicular to the blade height direction, the cavity 72 extends inside and outside the projection region of the contour of the reference airfoil 34A (i.e., extends so as to protrude from the inside of the contour of the reference airfoil 34A). That is, since the blade tip portion of the turbine blade 30 including the shroud portion 52 is provided with the cavity 72 that is large in the blade height direction and as viewed from the blade height direction, the weight of the blade tip portion can be effectively reduced. Thus, it is possible to effectively reduce the centrifugal load applied to the turbine blade 30 and suppress the reduction in the life of the turbine blade 30.

Further, according to the above-described embodiment, since the depth of the cavity 72 extends to the fillet portion 40 in the blade height direction, the fillet portion 40 can be effectively cooled. Consequently, it is possible to effectively suppress the reduction in the life of the turbine blade 30.

In some embodiments, the cavity 72 disposed on the leading edge 42 side in the chord direction (see FIG. 3) of the reference airfoil 34A among the plurality of cooling cavities 70 protrudes from the projection region of the contour of the reference airfoil 34A to the suction surface 48 side of the airfoil portion 34 in a cross-section perpendicular to the blade height direction. For example, as shown in FIG. 3, when viewed in the blade height direction, the outer portion of the leading edge-side cavity 70A (the portion extending outside the reference airfoil 34) includes a suction surface-side outer portion 102 protruding to the suction surface 48 side of the airfoil portion 34 (reference airfoil).

On the leading edge 42 side, the shroud portion 52 usually has a relatively large mass on the suction surface 48 side, which causes the center of gravity of the shroud portion 52 to be biased toward the suction surface 48 side. In this regard, according to the above-described embodiment, since the contour of the leading edge-side cavity 70A protrudes from the projection region of the reference airfoil 34A to the suction surface 48 side in a cross-section perpendicular to the blade height direction, the center of gravity of the shroud portion 52 on the leading edge 42 side can be brought closer to the central portion of the shroud portion 52 in the turbine axial direction. By adjusting the position of the center of gravity in this manner, the centrifugal load applied to the turbine blade 30 can be effectively reduced while adjusting the stress balance between the pressure surface 46 side and the suction surface 48 side of the turbine blade 30.

In some embodiments, the cavity 72 disposed on the trailing edge 44 side in the chord direction (see FIG. 3) of the reference airfoil 34A among the plurality of cooling cavities 70 protrudes from the projection region of the contour of the reference airfoil 34A to the pressure surface 46 side of the airfoil portion 34 in a cross-section perpendicular to the blade height direction. For example, as shown in FIG. 3, when viewed in the blade height direction, the outer portion of the trailing edge-side cavity 70B (the portion extending outside the reference airfoil 34) includes a pressure surface-side outer portion 104 protruding to the pressure surface 46 side of the airfoil portion 34 (reference airfoil).

On the trailing edge 44 side, the shroud portion 52 usually has a relatively large mass on the pressure surface 46 side, which causes the center of gravity of the shroud portion 52 to be biased toward the pressure surface 46 side. In this regard, according to the above-described embodiment, since the contour of the trailing edge-side cavity 70B protrudes from the projection region of the reference airfoil 34A to the pressure surface 46 side in a cross-section perpendicular to the blade height direction, the center of gravity of the shroud portion 52 on the trailing edge 44 side can be brought closer to the central portion of the shroud portion 52 in the turbine axial direction. By adjusting the position of the center of gravity in this manner, the centrifugal load applied to the turbine blade 30 can be effectively reduced while adjusting the stress balance between the pressure surface 46 side and the suction surface 48 side of the turbine blade 30.

Figure 5:
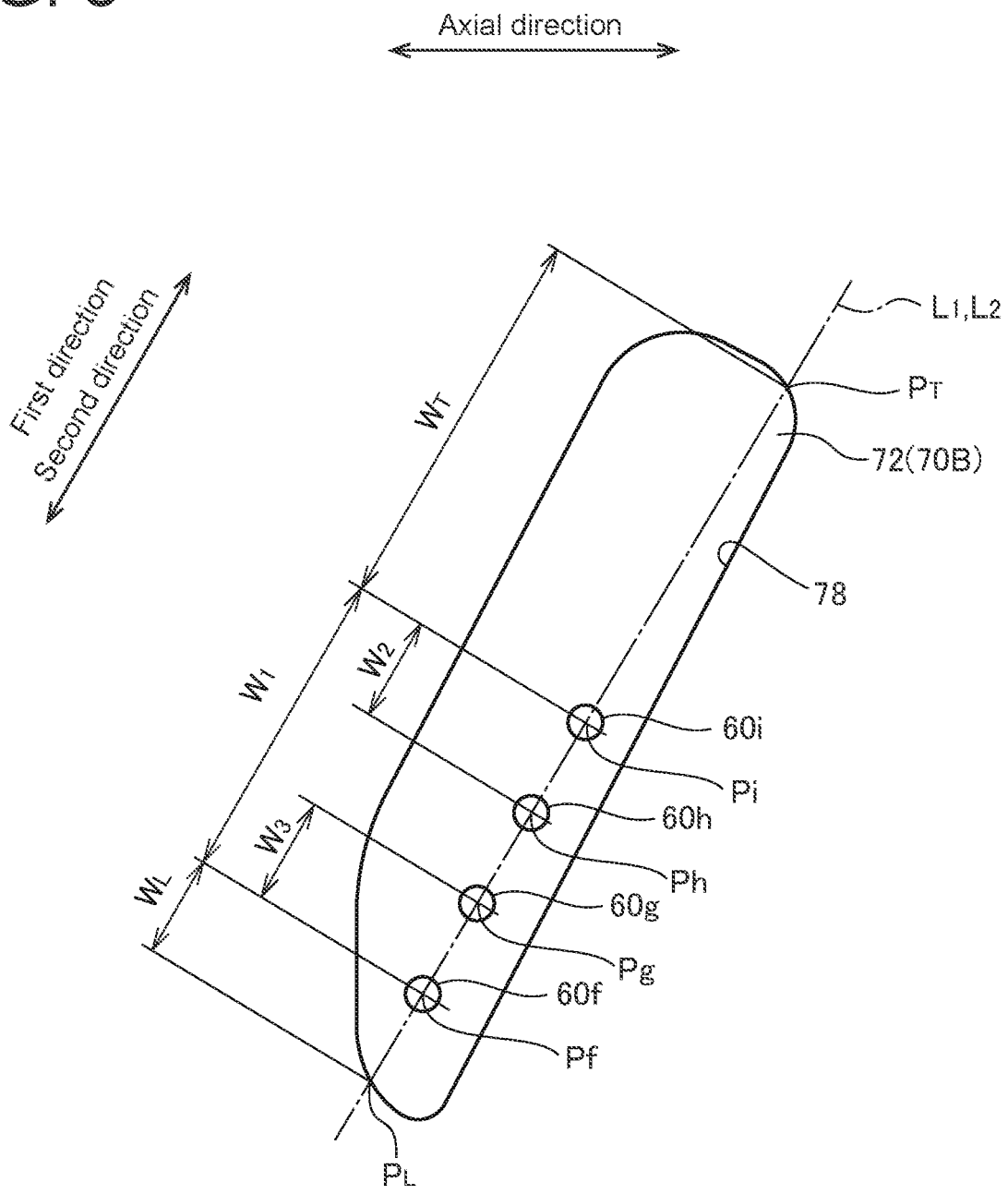
FIG. 5 is a schematic diagram of a cavity according to an embodiment, when viewed in the blade height direction.
Figure 6:
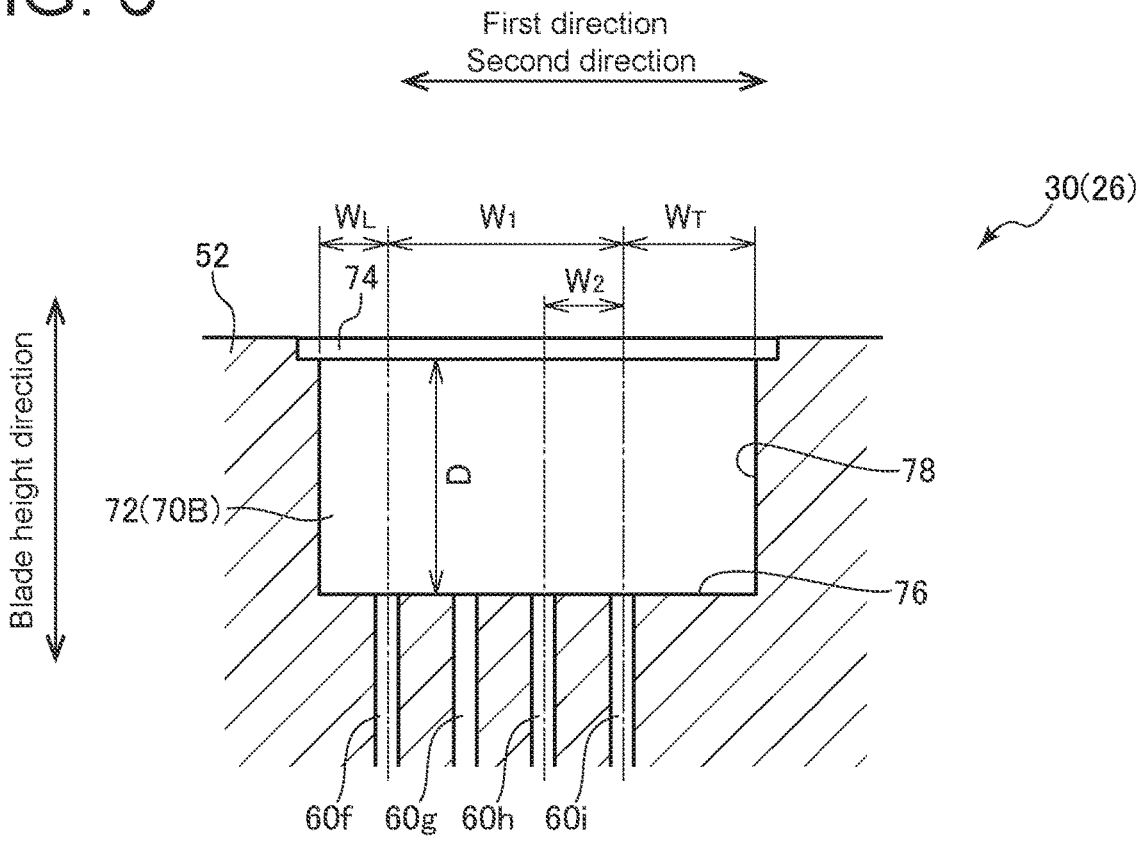
FIG. 6 is a schematic cross-sectional view of a turbine blade including a cavity according to an embodiment.
Figure 7:
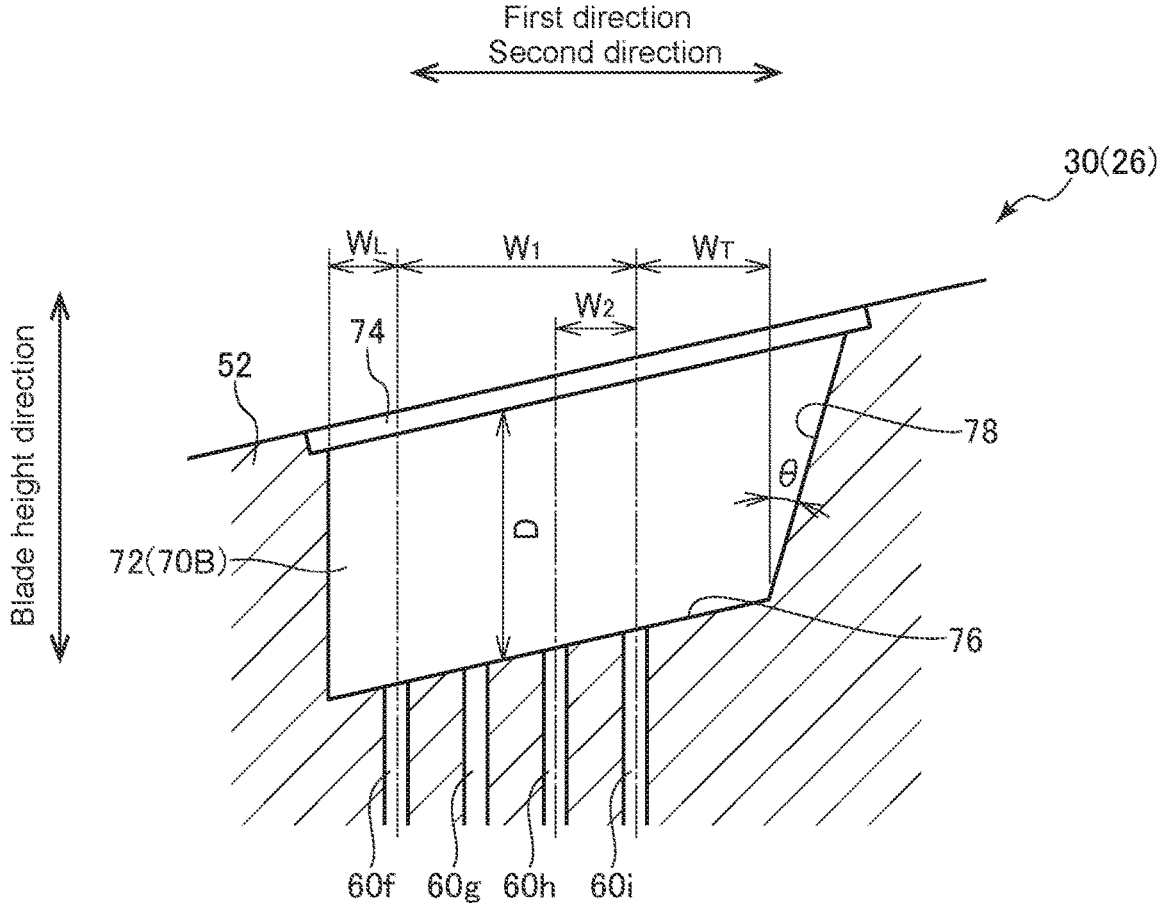
FIG. 7 is a schematic cross-sectional view of a turbine blade including a cavity according to an embodiment.
Figure 8:
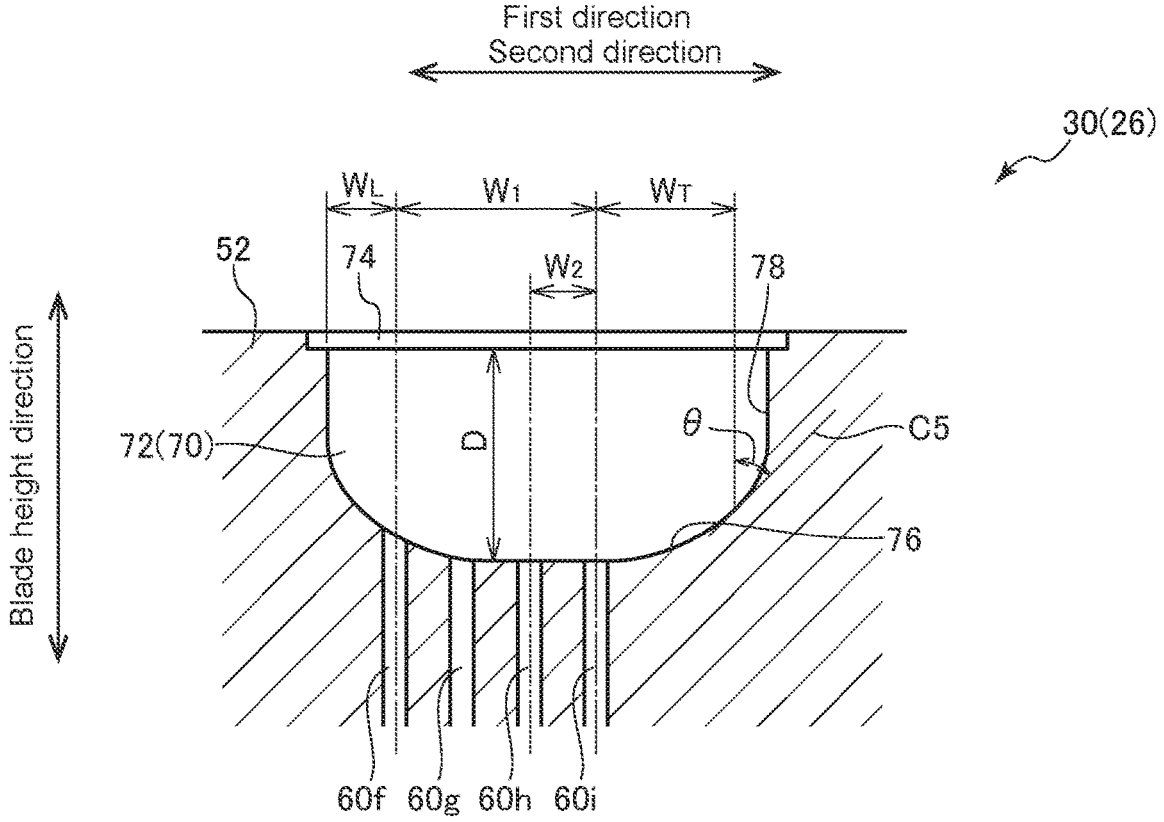
FIG. 8 is a schematic cross-sectional view of a turbine blade including a cavity according to an embodiment.

FIG. 5 is a schematic diagram of the cavity 72 (in this example, trailing edge-side cavity 70B) according to an embodiment, when viewed in the blade height direction. FIGS. 6 to 8 are each a schematic cross-sectional view of the turbine blade 30 including the cavity 72 according to an embodiment, in a plane including the blade height direction and a first direction or a second direction, which will be described later.

Hereinafter, features of the turbine blade 30 according to some embodiments will be described with reference to the figures (FIGS. 5 to 8) of the trailing edge-side cavity 70B as an example of the cavity 72, but the same description applies to the case of the leading edge-side cavity 70A.

As shown in FIGS. 3 to 8, the first cooling holes 60*f* to 60*i* connected to the trailing edge-side cavity 70B are arranged along the camber line (see FIG. 3) of the airfoil portion 34 and open to the bottom surface 76 of the trailing edge-side cavity 70B.

In some embodiments, when viewed in the blade height direction, on a straight line L1 connecting the centers (Pf, Pi) of openings of two first cooling holes 60 (in FIG. 5, first cooling holes 60*f*, 60*i*) at both ends in a direction along the camber line, a distance ($W_L$ or $W_T$) between the inner wall surface 78 of the cavity 72 and the center (Pf, Pi) of the opening of at least one of the two first cooling holes 60*f*, 60*i* is 0.8 times or more a distance W1 between the centers of the two first cooling holes 60*f*, 60*i*. In this case, the number of first cooling holes 60 that opens to the bottom surface 76 of the cavity 72 may be three or more.

Here, when viewed in the blade height direction, a direction of the straight line L1 connecting the centers (Pf, Pi) of openings of two first cooling holes 60*f*, 60*i* at both ends in the direction along the camber line among the plurality of first cooling holes 60*f* to 60*i* is defined as a first direction. Two intersections between the inner wall surface 78 of the cavity 72 and the straight line L1 in the first direction includes an intersection $P_L$ on the leading edge 42 side and an intersection $P_T$ on the trailing edge 44 side.

The distance $W_L$ is a distance $W_L$ on the straight line L1 between the intersection $P_L$ on the leading edge 42 side and the first cooling hole 60*f* disposed closer to the leading edge 42 of the two first cooling holes 60*f*, 60*i*. The distance $W_T$ is a distance $W_T$ on the straight line L1 between the intersection $P_T$ on the trailing edge 44 side and the first cooling hole 60*i* disposed closer to the trailing edge 44 of the two first cooling holes 60*f*, 60*i*.

Since the position of the first cooling hole 60 and the size (diameter, etc.) of the first cooling hole 60 are limited by the airfoil portion 34, the size of the region where the openings of the first cooling holes 60 exist (i.e., the distance W1 between the centers of the first cooling holes 60*f*, 60*i* at both ends) when viewed in the blade height direction is largely determined according to the airfoil (e.g., reference airfoil 34A) at the blade tip portion. In this regard, in the above-described embodiment, a large cavity 72 is provided so that the distance $W_L$ or $W_T$ between the inner wall surface 78 of the cavity 72 and the opening of one of the first cooling holes 60*f*, 60*i* at both ends in the direction along the camber line is 0.8 times or more the distance W1 between the centers of the openings of the first cooling holes 60*f*, 60*i*, when viewed in the blade height direction. Thus, the weight of the tip portion of the turbine blade 30 including the shroud portion 52 can be efficiently reduced, and the centrifugal load applied to the turbine blade 30 can be effectively reduced.

In some embodiments, when viewed in the blade height direction, on a straight line connecting the centers of openings of two first cooling holes closest to the leading edge 42A or the trailing edge 44A at the reference position $P_A$ among the plurality of first cooling holes 60, a distance ($W_L$ or $W_T$) between the inner wall surface 78 of the cavity 72 and the center of the opening of the first cooling hole 60 closest to the leading edge 42A or the trailing edge 44A at the reference position $P_A$ among the plurality of first cooling holes 60 is 1.5 times or more a distance (W2 or W3) between the centers of the openings of the two first cooling holes 60.

In an embodiment, for example as shown in FIG. 5, when viewed in the blade height direction, on a straight line L2 connecting the centers (Ph, Pi) of openings of two first cooling holes 60*h*, 60*i* closest to the trailing edge 44A among the plurality of first cooling holes 60, a distance $W_T$ between the inner wall surface 78 of the cavity 72 and the first cooling hole 60*i* closest to the trailing edge 44A may be 1.5 times or more a distance W2 between the centers of the openings of the two first cooling holes 60*h*, 60*i*.

Alternatively, in an embodiment, when viewed in the blade height direction, on a straight line (in FIG. 5, the same line as the straight line L2) connecting the centers (Pf, Pg) of openings of two first cooling holes 60*f*, 60*g* closest to the trailing edge 44A among the plurality of first cooling holes 60, a distance $W_L$ between the inner wall surface 78 of the cavity 72 and the first cooling hole 60*f* closest to the leading edge 42A may be 1.5 times or more a distance W3 (see FIG. 5) between the centers of the openings of the two first cooling holes 60*f*, 60*g*.

Here, when viewed in the blade height direction, a direction of the straight line (i.e., straight line L2) connecting the centers of openings of two first cooling holes (first cooling holes 60*f*, 60*g* or first cooling holes 60*h*, 60*i*) closest to the leading edge 42A or the trailing edge 44A among the plurality of first cooling holes 60*f* to 60*i* is defined as a second direction. Two intersections between the inner wall surface 78 of the cavity 72 and the straight line L2 in the second direction includes an intersection $P_L$ on the leading edge 42 side and an intersection $P_T$ on the trailing edge 44 side. In the embodiment shown in FIG. 5, the first direction and the second direction are the same direction.

Since the position of the first cooling hole 60 and the size (diameter, etc.) of the first cooling hole 60 are limited by the airfoil portion 34, the distance W2 or W3 between the centers of two first cooling holes 60 (first cooling holes 60*f*, 60*g* or first cooling holes 60*h*, 60*i*) adjacent to the leading edge 42A or the trailing edge 44A when viewed in the blade height direction is largely determined according to the airfoil at the blade tip portion. In this regard, in the above-described embodiment, a large cavity 72 is provided so that the distance $W_L$ or $W_T$ between the inner wall surface 78 of the cavity 72 and the opening of one of the first cooling holes 60 (first cooling holes 60*f*, 60*g* or first cooling holes 60*h*, 60*i*) disposed adjacent to the leading edge 42A or the trailing edge 44A in the direction along the camber line is 1.5 times or more the distance W2 or W3 between the centers of the openings of these first cooling holes 60, when viewed in the blade height direction. Thus, the weight of the tip portion of the turbine blade 30 including the shroud portion 52 can be efficiently reduced, and the centrifugal load applied to the turbine blade 30 can be effectively reduced.

As shown in FIGS. 6 to 8, in a cross-section including the blade height direction and the first direction or the second direction, the bottom surface 76 of the cavity 72 extends along the direction perpendicular to the blade height direction, and the inner wall surface 78 of the cavity 72 extends along the blade height direction.

In some embodiments, as shown in FIG. 7 or 8, the bottom surface 76 of the cavity 72 may be oblique to the direction perpendicular to the blade height direction or may be formed at least partially by a curved surface.

Further, in some embodiments, as shown in FIG. 7 or 8, the inner wall surface 78 of the cavity 72 may be oblique to the blade height direction or may be formed at least partially by a curved surface. For example, in a cross-section including the blade height direction and the first direction or the second direction, a portion of the surface forming the cavity 72 where the angle θ (see FIG. 7) between the surface and the blade height direction or the angle θ (see FIG. 8) between the tangent line L3 on the surface and the blade height direction is 45 degrees or less may be regarded as the inner wall surface 78. As described above, when the inner wall surface 78 of the cavity 72 is oblique to the blade height direction or is formed at least partially by a curved surface, the distance between the opening center of the first cooling hole 60 and the inner wall surface 78 is the distance between the opening center of the first cooling hole 60 and the position of the inner wall surface 78 closest to the first cooling hole 60.

Figure 9:
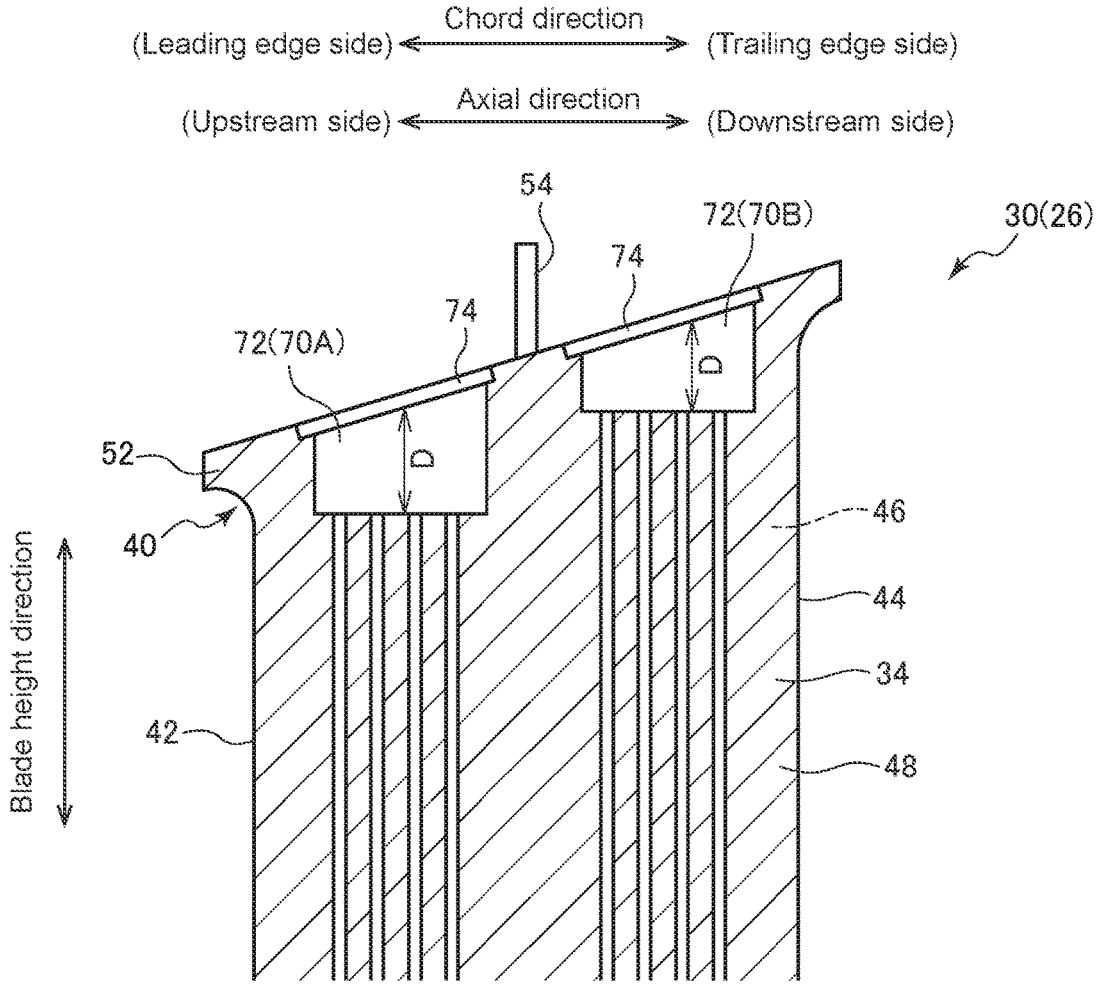
FIG. 9 is a schematic cross-sectional view of a turbine blade including a cavity according to an embodiment.

FIG. 9 is a schematic cross-sectional view of the turbine blade 30 including the cavity 72 according to an embodiment, in a plane including the blade height direction and the chord direction at the reference position $P_A$.

In some embodiments, in a cross-section including the blade height direction and the chord direction at the reference position $P_A$, the depth D (see FIG. 9) of the cavity 72 in the blade height direction increases from the leading edge 42A to the trailing edge 44A in the chord direction of the airfoil portion 34 at the reference position $P_A$ (the chord direction of the reference airfoil 34A). Alternatively, in some embodiments, in a cross-section including the blade height direction and the chord direction at the reference position $P_A$, the depth D (see FIG. 9) of the cavity 72 in the blade height direction increases from upstream to downstream in the axial direction of the rotor 8 of the turbine 6.

When a point moves from a leading edge-side point to a trailing edge-side point in the chord direction at the reference position $P_A$, it moves from upstream to downstream in the axial direction. Therefore, "the depth increases from the leading edge 42A to the trailing edge 44A" and "the depth increases from upstream to downstream in the axial direction" are substantially synonymous.

In the exemplary embodiment shown in FIG. 9, regarding both the leading edge-side cavity 70A and the trailing edge-side cavity 70B, the depth D of the cavity 72 in the blade height direction increases from the leading edge 42A to the trailing edge 44A in the chord direction of the airfoil portion 34 at the reference position $P_A$ (the chord direction of the reference airfoil 34A).

According to the above-described embodiment, since the depth D of the cavity 72 in the blade height direction increases as it approaches the trailing edge 44A (or downstream), the weight of the tip portion of the turbine blade 30 including the shroud portion 52 can be effectively reduced. For example, in a turbine blade 30 whose dimension in the blade height direction increases from the leading edge 42 to the trailing edge 44, when the cavity 72 is formed deeper on the trailing edge 44 side by utilizing the blade height of the portion on the trailing edge 44 side, the weight of the tip portion of the turbine blade 30 can be effectively reduced. Thus, it is possible to effectively reduce the centrifugal load applied to the turbine blade 30.

In some embodiments, for example as shown in FIG. 3, when viewed in the blade height direction, the extended line of the contact surface (first abutment surface 68 or second abutment surface 69) of the shroud portion 52 passes through the cavity 72. In the exemplary embodiment shown in FIG. 3, when viewed in the blade height direction, the extended line L4 of the first abutment surface 68 passes through the leading edge-side cavity 70A. Further, in the exemplary embodiment shown in FIG. 3, when viewed in the blade height direction, the extended line L5 of the second abutment surface 69 passes through the trailing edge-side cavity 70B.

The contact surface (first abutment surface 68 or second abutment surface 69) is disposed at the circumferential end portion of the shroud portion 52, and when viewed in the blade height direction, the extended line (L4 or L5) of the contact surface generally passes through the circumferential end portion of the shroud portion 52. In this regard, in the above-described embodiment, since the extended line (L4 or L5) of the contact surface passes through the cavity 72, the cavity 72 extends to the circumferential end portion of the shroud portion 52 when viewed in the blade height direction. Thus, according to the above-described embodiment, since the tip portion of the turbine blade 30 including the shroud portion 52 is provided with a large cavity 72 that extends to the circumferential end portion, the weight of the tip portion can be effectively reduced. Thus, it is possible to effectively reduce the centrifugal load applied to the turbine blade 30 and suppress the reduction in the life of the turbine blade 30.

In some embodiments, the second cooling hole 62 is connected to a portion of the cavity 72 disposed outside the region where the contour of the reference airfoil 34A is projected in the blade height direction on a cross-section perpendicular to the blade height direction (i.e., the above-described outer portion).

For example, in the exemplary embodiment shown in FIGS. 3 and 4, the second cooling hole 62 connected to the leading edge-side cavity 70A is connected to the suction surface-side outer portion 102 of the leading edge-side cavity 70A protruding to the suction surface 48 side of the airfoil portion 34 (reference airfoil) when viewed in the blade height direction. Further, for example, in the exemplary embodiment shown in FIGS. 3 and 4, the second cooling hole 62 connected to the trailing edge-side cavity 70B is connected to the pressure surface-side outer portion 104 of the trailing edge-side cavity 70B protruding to the pressure surface 46 side of the airfoil portion 34 (reference airfoil) when viewed in the blade height direction.

On the side (pressure surface 46 side or suction surface 48 side) where the cavity 72 protrudes from the projection region of the reference airfoil 34A on the above-described cross-section when viewed in the blade height direction, generally, the fillet portion 40 is relatively large or the width of the shroud portion 52 (e.g., the width in the direction perpendicular to the chord direction of the reference airfoil 34A) is relatively large. In this regard, according to the above-described embodiment, since the second cooling hole 62 is connected to the portion protruding from the projection region of the reference airfoil 34A on the above-described cross-section viewed in the blade height direction, the shroud portion 52 and the fillet portion 40 can be effectively cooled.

In some embodiments, for example as shown in FIGS. 3 and 4, the second cooling hole 62 extends on both sides of the fin 54 so as to straddle the fin 54 when viewed in the blade height direction.

In the above-described embodiment, since a relatively long second cooling hole 62 is disposed so as to straddle the fin 54 and extend on both sides of the fin 54 when viewed in the blade height direction, the shroud portion 52 and the fillet portion 40 can be effectively cooled.

In some embodiments, for example as shown in FIG. 4, the second cooling hole 62 extends so as to at least partially overlap the fillet portion 40 in the blade height direction. In the exemplary embodiment shown in FIG. 4, in the blade height direction, the second cooling hole 62 extends so as to at least partially overlap the extension region Ra1 of the fillet portion 40 on the pressure surface 46 side. Further, the second cooling hole 62 extends so as to at least partially overlap the extension region Rb1 of the fillet portion 40 on the suction surface 48 side.

In the above-described embodiment, since the second cooling hole 62 is disposed so as to at least partially overlap the fillet portion 40 in the blade height direction, by supplying a cooling fluid to the second cooling hole 62, the fillet portion 40 can be effectively cooled.

The contents described in the above embodiments would be understood as follows, for instance.

(1) A turbine blade (30) according to at least one embodiment of the present invention comprises: an airfoil portion (34) extending in a blade height direction and having a pressure surface (46) and a suction surface (48) each of which extends between a leading edge (42) and a trailing edge (44); a shroud portion (52) disposed on a blade tip side of the airfoil portion; a fillet portion (40) formed by a curved surface (40*a*) and connected to an end portion of the shroud portion on a side of the airfoil portion; at least one first cooling hole (60) extending along the blade height direction within the airfoil portion; at least one cooling cavity (70) disposed at least partially within the shroud portion and communicating with the at least one first cooling hole; and a second cooling hole (62) connected to the at least one cooling cavity and opening to a surface of the shroud portion. The airfoil portion has a reference airfoil (34A) in which a maximum blade thickness is minimum at a reference position ($P_A$) in the blade height direction. The at least one cooling cavity includes a cavity (72) extending so as to overlap the fillet portion in the blade height direction. In a cross-section perpendicular to the blade height direction and including the cavity, the cavity (72) extends inside and outside a region where a contour of the reference airfoil is projected on the cross-section in the blade height direction.

According to the above configuration (1), a cavity is provided in the blade tip portion of the turbine blade including the shroud portion. The depth of the cavity extends to the fillet in the blade height direction. In a cross-section perpendicular to the blade height direction, the cavity extends inside and outside the projection region of the contour of the reference airfoil (i.e., extends so as to protrude from the inside of the contour of the reference airfoil). That is, since the tip portion of the turbine blade including the shroud portion is provided with the cavity that is large in the blade height direction and as viewed from the blade height direction, the weight of the tip portion can be effectively reduced. Thus, it is possible to effectively reduce the centrifugal load applied to the turbine blade and suppress the reduction in the life of the turbine blade.

(2) In some embodiments, in the above configuration (1), the at least one cooling cavity includes: a leading edge-side cavity (70A) as the cavity (72); and a trailing edge-side cavity (70B) disposed on a trailing edge side of the leading edge-side cavity in a chord direction of the airfoil portion at the reference position ($P_A$). In the cross-section, the leading edge-side cavity protrudes from the region to a suction surface side of the airfoil portion.

On the leading edge side, the shroud portion usually has a relatively large mass on the suction surface side, which causes the center of gravity of the shroud portion to be biased toward the suction surface side. In this regard, according to the above configuration (2), since the contour of the leading edge-side cavity protrudes from the projection region of the reference airfoil to the suction surface side in the above-described cross-section, the center of gravity of the shroud portion on the leading edge side can be brought closer to the central portion of the shroud portion in the turbine axial direction. By adjusting the position of the center of gravity in this manner, the centrifugal load applied to the turbine blade can be effectively reduced while adjusting the stress balance between the pressure surface side and the suction surface side of the turbine blade.

(3) In some embodiments, in the above configuration (1) or (2), the at least one cooling cavity includes: a leading edge-side cavity (70A); and a trailing edge-side cavity (70B), as the cavity (72), disposed on a trailing edge side of the leading edge-side cavity in a chord direction of the airfoil portion at the reference position. In the cross-section, the trailing edge-side cavity protrudes from the region to a pressure surface side of the airfoil portion.

On the trailing edge side, the shroud portion usually has a relatively large mass on the pressure surface side, which causes the center of gravity of the shroud portion to be biased toward the pressure surface side. In this regard, according to the above configuration (3), since the contour of the trailing edge-side cavity protrudes from the projection region of the reference airfoil to the pressure surface side in the above-described cross-section, the center of gravity of the shroud portion on the trailing edge side can be brought closer to the central portion of the shroud portion in the turbine axial direction. By adjusting the position of the center of gravity in this manner, the centrifugal load applied to the turbine blade can be effectively reduced while adjusting the stress balance between the pressure surface side and the suction surface side of the turbine blade.

(4) In some embodiments, in any one of the above configurations (1) to (3), the at least one first cooling hole (60) includes a plurality of the first cooling holes arranged along a camber line of the airfoil portion (34) and opening to a bottom surface (76) of the cavity. When the cavity is viewed in the blade height direction, on a straight line (L1) connecting centers of openings of two first cooling holes (e.g., first cooling holes 60*f*, 60*i*) at both ends in a direction along the camber line among the plurality of first cooling holes, a distance ($W_L$ or $W_T$) between an inner wall surface (78) of the cavity and the center of the opening of at least one of the two first cooling holes is 0.8 times or more a distance (W1) between the centers of the two first cooling holes.

Since the position of the first cooling hole and the size (diameter, etc.) of the first cooling hole are limited by the airfoil, the size of the region where the openings of the first cooling holes exist (i.e., the distance between the centers of the first cooling holes at both ends) when viewed in the blade height direction is largely determined according to the airfoil at the blade tip portion. According to the above configuration (4), a large cavity is provided so that the distance between the inner wall surface of the cavity and the center of the opening of one of the first cooling holes at both ends in the direction along the camber line is 0.8 times or more the distance between the centers of the openings of the first cooling holes at both ends, when viewed in the blade height direction. Thus, the weight of the tip portion of the turbine blade including the shroud portion can be efficiently reduced, and the centrifugal load applied to the turbine blade can be effectively reduced.

(5) In some embodiments, in any one of the above configurations (1) to (4), the at least one first cooling hole (60) includes a plurality of first cooling holes arranged along a camber line of the airfoil portion (34) and opening to a bottom surface (76) of the cavity. When the cavity is viewed in the blade height direction, on a straight line (L2) connecting centers of openings of two first cooling holes (e.g., first cooling holes 60*h*, 60*i*) closest to the leading edge or the trailing edge (e.g., trailing edge 44) at the reference position among the plurality of first cooling holes, a distance ($W_L$ or $W_T$) between an inner wall surface of the cavity and the center of the opening of the first cooling hole (e.g., first cooling hole 60*i*) closest to the leading edge or the trailing edge at the reference position among the plurality of first cooling holes is 1.5 times or more a distance (e.g., W3) between the centers of the openings of the two first cooling holes.

Since the position of the first cooling hole and the size (diameter, etc.) of the first cooling hole are limited by the airfoil, the distance between the centers of two first cooling holes adjacent to the leading edge or the trailing edge when viewed in the blade height direction is largely determined according to the airfoil at the blade tip portion. According to the above configuration (5), a large cavity is provided so that the distance between the inner wall surface of the cavity and the center of the opening of one of two first cooling holes adjacent to the leading edge or the trailing edge in the direction along the camber line is 1.5 times or more the distance between the centers of the openings of the two first cooling holes, when viewed in the blade height direction. Thus, the weight of the tip portion of the turbine blade including the shroud portion can be efficiently reduced, and the centrifugal load applied to the turbine blade can be effectively reduced.

(6) In some embodiments, in any one of the above configurations (1) to (5), a depth (D) of the cavity in the blade height direction increases from the leading edge (42) to the trailing edge (44) in a chord direction of the airfoil portion at the reference position.

According to the above configuration (6), since the depth of the cavity in the blade height direction increases as it approaches the trailing edge, the weight of the tip portion of the turbine blade including the shroud portion can be effectively reduced. For example, in a turbine blade whose dimension in the blade height direction increases from the leading edge to the trailing edge, when the cavity is formed deeper on the trailing edge side by utilizing the blade height of the trailing edge portion, the weight of the tip portion of the turbine blade can be effectively reduced. Thus, it is possible to effectively reduce the centrifugal load applied to the turbine blade.

(7) In some embodiments, in any one of the above configurations (1) to (6), the shroud portion (52) has a contact surface (e.g., first abutment surface 68 or second abutment surface 69) extending along the blade height direction and facing a shroud portion of a turbine blade adjacent to the turbine blade, and an extended line (L4 or L5) of the contact surface passes through the cavity when viewed in the blade height direction.

The contact surface is disposed at the circumferential end portion of the shroud portion, and when viewed in the blade height direction, the extended line of the contact surface generally passes through the circumferential end portion of the shroud portion. In this regard, in the above configuration (7), since the extended line of the contact surface passes through the cavity, the cavity extends to the circumferential end portion of the shroud portion when viewed in the blade height direction. Thus, according to the above configuration (7), since the tip portion of the turbine blade including the shroud portion is provided with a large cavity that extends to the circumferential end portion, the weight of the tip portion can be effectively reduced. Thus, it is possible to effectively reduce the centrifugal load applied to the turbine blade and suppress the reduction in the life of the turbine blade.

(8) In some embodiments, in any one of the above configurations (1) to (7), the second cooling hole (62) is connected to a portion (e.g., suction surface-side outer portion 102 or pressure surface-side outer portion 104) of the cavity (72) disposed outside the region when viewed in the blade height direction.

On the side (leading edge side or suction surface side) where the cavity protrudes from the projection region of the reference airfoil on the above-described cross-section when viewed in the blade height direction, generally, the fillet portion is relatively large or the width of the shroud portion is relatively large. In this regard, according to the above configuration (8), since the second cooling hole is connected to the portion protruding from the projection region of the reference airfoil on the above-described cross-section viewed in the blade height direction, the shroud portion and the fillet portion can be effectively cooled.

(9) In some embodiments, in any one of the above configurations (1) to (8), the turbine blade further comprises a fin (54) protruding from the shroud portion to the blade tip side and extending along a circumferential direction. The second cooling hole (62) extends on both sides of the fin so as to straddle the fin when viewed in the blade height direction.

According to the above configuration (9), since a relatively long second cooling hole is disposed so as to straddle the fin and extend on both sides of the fin when viewed in the blade height direction, the shroud portion and the fillet portion can be effectively cooled.

(10) In some embodiments, in any one of the above configurations (1) to (9), the second cooling hole (62) extends so as to at least partially overlap the fillet portion (40) in the blade height direction.

According to the above configuration (10), since the second cooling hole is disposed so as to at least partially overlap the fillet portion in the blade height direction, the fillet portion can be effectively cooled.

(11) A gas turbine (1) according to at least one embodiment of the present invention comprises: the turbine blade (24, 26, 30) described in any one of the above (1) to (10); and a combustor (4) for producing a combustion gas flowing through a combustion gas passage (28) in which the turbine blade is disposed.

According to the above configuration (11), a cavity is provided in the blade tip portion of the turbine blade including the shroud portion. The depth of the cavity extends to the fillet in the blade height direction. In a cross-section perpendicular to the blade height direction, the cavity extends inside and outside the projection region of the contour of the reference airfoil (i.e., extends so as to protrude from the inside of the contour of the reference airfoil). That is, since the tip portion of the turbine blade including the shroud portion is provided with the cavity that is large in the blade height direction and as viewed from the blade height direction, the weight of the tip portion can be effectively reduced. Thus, it is possible to effectively reduce the centrifugal load applied to the turbine blade and suppress the reduction in the life of the turbine blade.

Embodiments of the present invention were described in detail above, but the present invention is not limited thereto, and various amendments and modifications may be implemented.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", and "have" are not intended to be exclusive of other components.

REFERENCE SIGNS LIST

1 Gas turbine
2 Compressor
4 Combustor
6 Turbine
8 Rotor
10 Compressor casing
12 Air inlet
16 Stator blade
18 Rotor blade
20 Casing
22 Turbine casing
24 Stator blade
26 Rotor blade
28 Combustion gas passage
29 Exhaust chamber
30 Turbine blade
32 Platform
34 Airfoil portion
34A Reference airfoil
36 Blade root portion
38 Base end portion
39 Tip end portion
40 Fillet portion
40*a* Curved surface
42 Leading edge
42A Leading edge
44 Trailing edge
44A Trailing edge
46 Pressure surface
46A Pressure surface
48 Suction surface
48A Suction surface
52 Shroud portion
52*a* Flat surface
52*b* Blade tip-side end surface
54 Fin
58 Inlet opening
60, 60*a* to 60*i* First cooling hole
62 Second cooling hole
63 Opening
66 Upstream end surface
67 Downstream end surface
68 First abutment surface

69 Second abutment surface
70 Cooling cavity
70A Leading edge-side cavity
70B Trailing edge-side cavity
72 Cavity
74 Plug
76 Bottom surface
78 Inner wall surface
102 Suction surface-side outer portion
104 Pressure surface-side outer portion
$Lc_A$ Camber line
$P_A$ Reference position
Ra1 Extension region
Rb1 Extension region

The invention claimed is:

1. A turbine blade, comprising:

an airfoil portion extending in a blade height direction and having a pressure surface and a suction surface each of which extends between a leading edge and a trailing edge;

a shroud portion disposed on a blade tip side of the airfoil portion;

a fillet portion formed by a curved surface and connected to an end portion of the shroud portion on a side of the airfoil portion;

at least one first cooling hole extending along the blade height direction within the airfoil portion;

at least one cooling cavity disposed at least partially within the shroud portion and communicating with the at least one first cooling hole; and a second cooling hole connected to the at least one cooling cavity and opening to a surface of the shroud portion, wherein the airfoil portion has a reference airfoil in which a maximum blade thickness is minimum at a reference position in the blade height direction, wherein the at least one cooling cavity includes a cavity extending so as to overlap the fillet portion in the blade height direction, wherein, in a cross-section perpendicular to the blade height direction and including the cavity, the cavity extends inside and outside a region where a contour of the reference airfoil is projected on the cross-section in the blade height direction, and wherein in the blade height direction, at least a part of the cavity is disposed in an extending region of the fillet portion.

2. The turbine blade according to claim 1, wherein the at least one cooling cavity includes:

a leading edge-side cavity as the cavity; and a trailing edge-side cavity disposed on a trailing edge side of the leading edge-side cavity in a chord direction of the airfoil portion at the reference position, and wherein, in the cross-section, the leading edge-side cavity protrudes from the region to a suction surface side of the airfoil portion.

3. The turbine blade according to claim 1, wherein the at least one cooling cavity includes:

a leading edge-side cavity; and a trailing edge-side cavity, as the cavity, disposed on a trailing edge side of the leading edge-side cavity in a chord direction of the airfoil portion at the reference position, and wherein, in the cross-section, the trailing edge-side cavity protrudes from the region to a pressure surface side of the airfoil portion.

4. The turbine blade according to claim 1, wherein the at least one first cooling hole includes a plurality of the first cooling holes arranged along a camber line of the airfoil portion and opening to a bottom surface of the cavity, and wherein, when the cavity is viewed in the blade height direction, on a straight line connecting centers of openings of two first cooling holes at both ends in a direction along the camber line among the plurality of first cooling holes, a distance between an inner wall surface of the cavity and the center of the opening of at least one of the two first cooling holes is 0.8 times or more a distance between the centers of the two first cooling holes.

5. The turbine blade according to claim 1, wherein the at least one first cooling hole includes a plurality of first cooling holes arranged along a camber line of the airfoil portion and opening to a bottom surface of the cavity, and wherein, when the cavity is viewed in the blade height direction, on a straight line connecting centers of openings of two first cooling holes closest to the leading edge or the trailing edge at the reference position among the plurality of first cooling holes, a distance between an inner wall surface of the cavity and the center of the opening of the first cooling hole closest to the leading edge or the trailing edge at the reference position among the plurality of first cooling holes is 1.5 times or more a distance between the centers of the openings of the two first cooling holes.

6. The turbine blade according to claim 1, wherein the shroud portion has a contact surface extending along the blade height direction and facing a shroud portion of a turbine blade adjacent to the turbine blade, and wherein, an extended line of the contact surface passes through the cavity when viewed in the blade height direction.

7. The turbine blade according to claim 1, wherein the second cooling hole is connected to a portion of the cavity disposed outside the region when viewed in the blade height direction.

8. The turbine blade according to claim 1, wherein the second cooling hole extends so as to at least partially overlap the fillet portion in the blade height direction.

9. A gas turbine, comprising:

the turbine blade according to claim 1; and a combustor for producing a combustion gas flowing through a combustion gas passage provided with the turbine blade.

10. A turbine blade, comprising:

an airfoil portion extending in a blade height direction and having a pressure surface and a suction surface each of which extends between a leading edge and a trailing edge;

a shroud portion disposed on a blade tip side of the airfoil portion;

a fillet portion formed by a curved surface and connected to an end portion of the shroud portion on a side of the airfoil portion;

at least one first cooling hole extending along the blade height direction within the airfoil portion;

at least one cooling cavity disposed at least partially within the shroud portion and communicating with the at least one first cooling hole; and a second cooling hole connected to the at least one cooling cavity and opening to a surface of the shroud portion, wherein the airfoil portion has a reference airfoil in which a maximum blade thickness is minimum at a reference position in the blade height direction, wherein the at least one cooling cavity includes a cavity extending so as to overlap the fillet portion in the blade height direction, wherein, in a cross-section perpendicular to the blade height direction and including the cavity, the cavity extends inside and outside a region where a contour of the reference airfoil is projected on the cross-section in the blade height direction, and wherein a depth of the cavity in the blade height direction increases from the leading edge to the trailing edge in a chord direction of the airfoil portion at the reference position.

11. A gas turbine, comprising:

the turbine blade according to claim 10; and a combustor for producing a combustion gas flowing through a combustion gas passage provided with the turbine blade.

12. A turbine blade, comprising:

an airfoil portion extending in a blade height direction and having a pressure surface and a suction surface each of which extends between a leading edge and a trailing edge;

a shroud portion disposed on a blade tip side of the airfoil portion;

a fillet portion formed by a curved surface and connected to an end portion of the shroud portion on a side of the airfoil portion;

at least one first cooling hole extending along the blade height direction within the airfoil portion;

at least one cooling cavity disposed at least partially within the shroud portion and communicating with the at least one first cooling hole; and a second cooling hole connected to the at least one cooling cavity and opening to a surface of the shroud portion, wherein the airfoil portion has a reference airfoil in which a maximum blade thickness is minimum at a reference position in the blade height direction, wherein the at least one cooling cavity includes a cavity extending so as to overlap the fillet portion in the blade height direction, wherein, in a cross-section perpendicular to the blade height direction and including the cavity, the cavity extends inside and outside a region where a contour of the reference airfoil is projected on the cross-section in the blade height direction, wherein the turbine blade further comprises a fin protruding from the shroud portion to the blade tip side and extending along a circumferential direction, and wherein the second cooling hole extends on both sides of the fin so as to straddle the fin when viewed in the blade height direction.

13. A gas turbine, comprising:

the turbine blade according to claim 12; and a combustor for producing a combustion gas flowing through a combustion gas passage provided with the turbine blade.

* * * * *